US006616026B1

(12) United States Patent
Wittmaier

(10) Patent No.: US 6,616,026 B1
(45) Date of Patent: Sep. 9, 2003

(54) DEVICE FOR APPLYING SPATIALLY LIMITED ELEMENTS, IN PARTICULAR, FLEXIBLE ELEMENTS

(75) Inventor: Klaus Wittmaier, Vaihingen/Enz (DE)

(73) Assignee: Schober GmbH Werkzeug- und Maschinenbau, Eberdingen (DE)

( * ) Notice: Subject to any disclaimer, the term of this patent is extended or adjusted under 35 U.S.C. 154(b) by 0 days.

(21) Appl. No.: 09/959,242

(22) PCT Filed: Apr. 12, 2000

(86) PCT No.: PCT/EP00/03271

§ 371 (c)(1),
(2), (4) Date: Oct. 18, 2001

(87) PCT Pub. No.: WO00/64794

PCT Pub. Date: Nov. 2, 2000

(30) Foreign Application Priority Data

Apr. 23, 1999 (DE) ..... 199 18 429

(51) Int. Cl.[7] ..... B65H 20/24; F16G 1/00
(52) U.S. Cl. ..... 226/113; 156/238; 156/540
(58) Field of Search ..... 226/113, 108, 226/117, 114; 156/230, 233, 238, 240, 241, 247, 289, 540

(56) References Cited

U.S. PATENT DOCUMENTS

| | | | | |
|---|---|---|---|---|
| 3,613,978 A | * | 10/1971 | Renold | 226/117 |
| 3,850,729 A | * | 11/1974 | Paulson et al. | 156/247 |
| 4,701,235 A | * | 10/1987 | Mitsam | 156/238 |
| 4,778,093 A | * | 10/1988 | Renold | 226/113 |
| 5,251,988 A | * | 10/1993 | Frazier | 226/113 |
| 5,277,571 A | | 1/1994 | Brining | |
| 5,371,521 A | * | 12/1994 | Wehrmann | 226/113 |
| 6,277,230 B1 | * | 8/2001 | Milko | 156/230 |
| 6,349,867 B1 | * | 2/2002 | Fernfors | 226/113 |

FOREIGN PATENT DOCUMENTS

| | | |
|---|---|---|
| CH | 365 259 | 10/1962 |
| EP | 0 858 888 | 8/1998 |

* cited by examiner

*Primary Examiner*—Michael R. Mansen
(74) *Attorney, Agent, or Firm*—Paul Vincent

(57) ABSTRACT

In a device for applying spatially limited, flexible elements (26) to a continuous web (14), in particular for applying holograms, the speed of the continuous web (14) is reduced In the application zone and the flexible element is applied at this time.

11 Claims, 1 Drawing Sheet

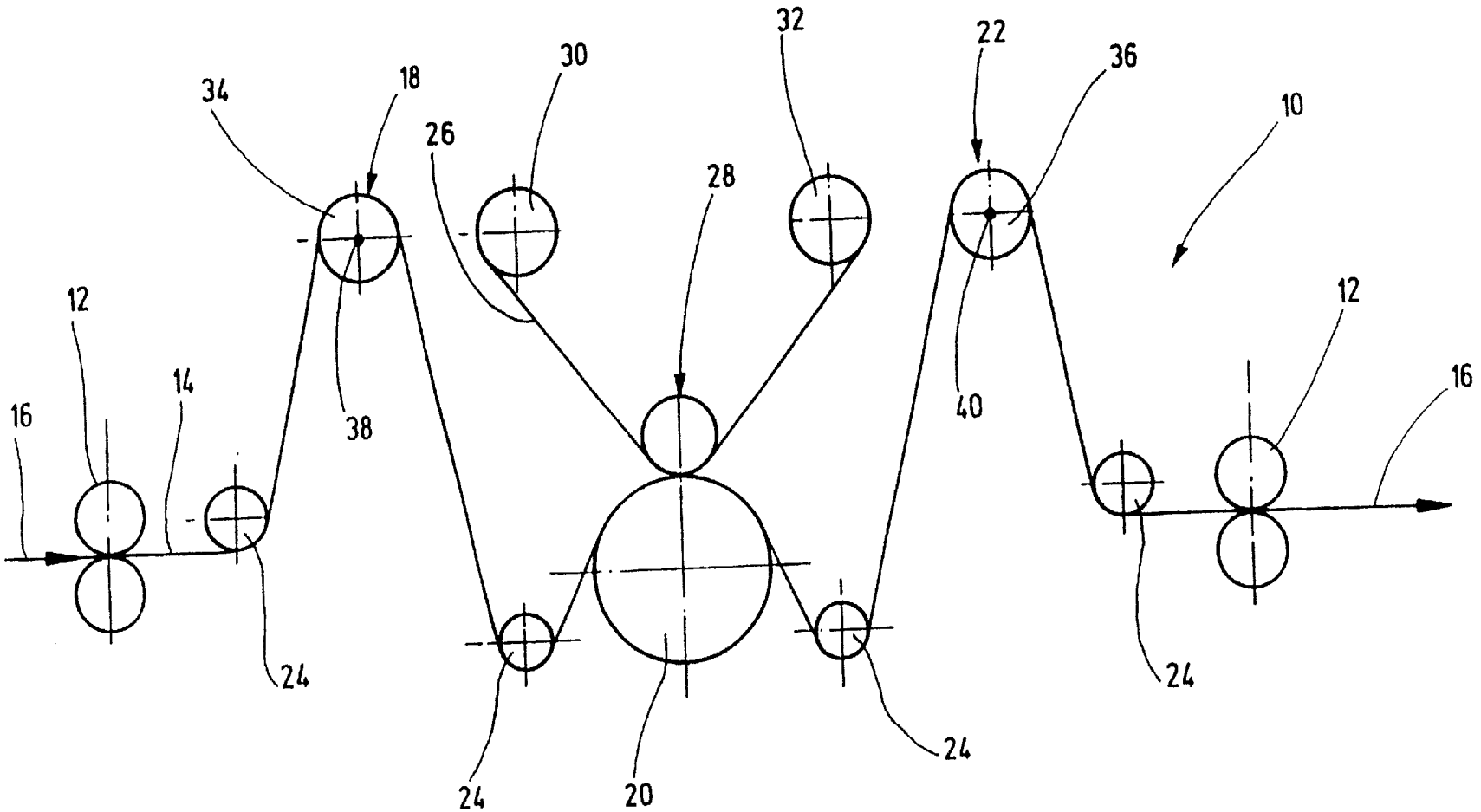
10
12
16
24
36
22
40
32
28
20
30
26
18
38
34
14

DEVICE FOR APPLYING SPATIALLY LIMITED ELEMENTS, IN PARTICULAR, FLEXIBLE ELEMENTS

Translation of PCT/EP00/03271 as filed on Apr. 12, 2000.

The invention concerns a device for applying spatially limited elements, in particular, flexible elements, e.g. holograms or the like, to a continuous web which is removed from a supply roll and transported via a sealing station to a removal or guiding station, wherein the flexible element is applied to the continuous web in the sealing station.

Conventionally, cards, notes, paper sheets or the like are produced by initial processing of a continuous web through printing, punching, stamping etc., and finally cutting or punching out the individual products from the continuous web. Also conventionally, the individual products are provided with spatially limited elements, e.g. images or very expensive holograms and the like. These spatially limited elements are also disposed on a continuous web from which they are removed for disposal on the first continuous web. If the two continuous webs move through the sealing station at the same speed, only a fraction of the second continuous web is used and the major part of the second continuous web must be disposed of as waste, since the spatially limited element is substantially smaller than the products onto which they are to be applied. The intermediate spaces between the individual spatially limited elements on the second continuous web therefore constitute waste.

It is consequently the underlying purpose of the present invention to provide a device which improves utilization of the second continuous web to reduce waste.

This object is achieved in accordance with the invention in that, in a device of the above-mentioned type, two eccentric stations are provided, one before and one after the sealing station, wherein each eccentric station comprises an eccentric shaft via which the continuous web is guided, wherein the two eccentric shafts circulate, mutually offset by 180°.

Provision of an eccentric station before and after the sealing station through which the continuous web is guided permits deceleration and acceleration of the transport speed of the material web in these eccentric stations, which therefore act as a temporary buffer. This is effected by the eccentric shafts via which the continuous web is guided. As the eccentric shafts turn, they gather and subsequently release the continuous web during eccentric deflection. A sinusoidal reciprocating motion is thereby superimposed on the transport speed of the continuous web such that the resulting transport speed has slow and fast travel.

If the spatially limited element, e.g. the hologram is also located on a continuous web, the hologram is applied to the first continuous web, when the latter moves at its minimum transport speed. The continuous web carrying the holograms must therefore only be transported at this minimum transport speed and the waste between the individual holograms is accordingly reduced. After application of the hologram to the first continuous web, the latter is accelerated again to its maximum speed and subsequently decelerated for applying the next hologram.

The eccentric shafts preferably move in the transport direction of the continuous web thereby minimizing the relative speed and therefore the friction between eccentric shaft and the continuous web.

In a preferred embodiment, the eccentric shafts have a circular cross-section and are eccentrically mounted. A circular cross-section of the eccentric shaft advantageously has, in contrast to a cam-shaped eccentric shaft, a protective effect on the continuous web since the forces of the eccentric shaft acting on it increase and decrease in a sinusoidal fashion, thereby avoiding abrupt force peaks.

The frictional forces are reduced by disposing a sleeve on the eccentric shaft which can rotate with respect to the eccentric shaft and which has zero speed relative to the transported web.

In accordance with a preferred embodiment, the eccentricity of the eccentric shafts can be adjusted. The amplitude of the sinusoidal acceleration or deceleration can thereby be adjusted to a desired value.

In a further development, the eccentric shafts circulate synchronously with the application cycle. Every time sealing is to be effected, the continuous web moves at a minimum transport speed. This facilitates precise sealing and, during application, the first continuous web also has the same speed as the second continuous web from which the hologram is removed.

Further advantages, features and details of the invention can be extracted from the dependent claims and the following detailed description of a particularly preferred embodiment, with reference to the drawing. The features shown in the drawing and mentioned in the description and in the claims may be essential to the invention either individually or collectively in any arbitrary combination.

BRIEF DESCRIPTION OF THE DRAWING

The FIGURE shows a schematic view of the device in accordance with the invention.

DESCRIPTION OF THE PREFERRED EMBODIMENT

The drawing shows a basic view of the inventive device 10. A continuous web 14 is removed from a supply roll (not shown) via a removal station 12 in the direction of the arrow 16. This continuous web 14 initially passes a first eccentric station 18 and is then guided into a sealing station 20. After the sealing station 20, it is guided via a second eccentric station 22 and transported by an additional removal station 12. Reference numeral 24 designates deflection or compensating rollers.

A hologram from a hologram foil 26 is applied to the continuous web 14 in the sealing station 20. This is effected via a stamping field which is provided on a sealing roller 28. The hologram foil 26 is optionally removed from a supply roll 30 via a transport device (not shown) and wound onto a winding roller 32.

Each of the two eccentric stations 18 and 22 has an eccentric shaft 34 and 36 which rotate about an axis 38 and 40, respectively. The two eccentric shafts 34 and 36 are mutually offset by 180°.

The two eccentric shafts 34 and 36 rotate synchronously such that the mutual 180° offset remains constant. The rotational speed corresponds to the transport speed of the continuous web 14 and is adjusted such that a product located on the continuous web 14 rotates once about each of the two eccentric shafts 34 and 36. This means that the section of the continuous web 14 is decelerated once and is accelerated once between the two eccentric stations 18 and 22, for each product passing the sealing station 20.

The transport speed of the hologram foil 26 is thereby set to correspond to the minimum transport speed of the section of the continuous web 14 located between the eccentric stations 18 and 22, wherein the hologram is applied at the time of minimum transport speed. At precisely this point in time, the hologram disposed on the hologram foil 26 is exactly in the desired position on the continuous web 14. This is achieved by means of a register control, e.g. the hologram foil 26 comprises a register perforation into which corresponding transport pins, register pins, or the sealing roller 28 engage. After application of the hologram to the continuous web 14, the continuous web 14 is accelerated, while the speed of the hologram foil 26 remains constant. In this fashion, the separation between the individual holograms is reduced such that the hologram foil 26 can be better utilized and waste is minimized.

What is claimed is:

1. A device for transferring spatially limited flexible elements from a first continuous web to objects disposed on a second continuous web, the flexible elements having an element size and element separation on the first continuous web which is substantially less than an object size of the objects disposed on the second continuous web, the device comprising:

a first supply roller for feeding the flexible elements and the first continuous web at a first web transport speed;

a second supply roller for feeding the objects disposed on the second continuous web at a second web transport speed which is substantially larger than said first web transport speed;

a sealing station disposed downstream of said first and said second supply rollers, wherein the flexible elements are transferred from the first continuous web to the objects disposed on the second continuous web at said sealing station;

a removal station disposed downstream of said sealing station for transporting the second continuous web with the objects having the transferred flexible elements, away from said sealing station;

a first acceleration and deceleration station cooperating with the second continuous web and disposed between said second supply roller and said sealing station; and a second acceleration and deceleration station cooperating with the second continuous web and disposed between said sealing station and said removal station, wherein the second continuous web is transported below and substantially parallel to the first continuous web, wherein said first web transport speed, said second web transport speed, said first acceleration and deceleration station, and said second acceleration and deceleration station cooperate to lower said second transport speed to said first transport speed at said sealing station for allowing successively adjacent flexible elements disposed on the first continuous web to be transferred at said sealing station to successively adjacent obects disposed on the second continuous web.

2. The device of claim 1, wherein said first acceleration and deceleration station comprises a first eccentric member having a first eccentric shaft and said second acceleration and deceleration station comprises a second eccentric member having a second eccentric shaft, said first eccentric shaft having a first rotation which is offset by 180° from a second rotation of said second eccentric shaft.

3. The device of claim 2, wherein said first and said second eccentric shafts rotate in a transport direction of the second continuous web.

4. The device of claim 2, wherein each of said first and said second eccentric shaft has a circular cross-section and is eccentrically mounted.

5. The device of claim 2, further comprising a first sleeve disposed on a first outer periphery of said first eccentric shaft for rotation relative thereto and a second sleeve disposed on a second outer periphery of said second eccentric shaft for rotation relative thereto.

6. The device of claim 2, wherein an eccentricity of each of said first and said second eccentric members can be changed by adjusting an eccentricity of said first and said second eccentric shafts.

7. The device of claim 2, wherein said first and said second eccentric shafts rotate synchronously with respect to an application cycle.

8. The device of claim 2, wherein the second continuous web is continuously removed from said second supply roll, wherein the second continuous web has a transport speed which can be changed in a region of said sealing station by means of said first and said second eccentric shafts.

9. The device of claim 1, wherein the elements are transferred at said sealing station when said second continuous web has a minimum speed.

10. The device of claim 1, wherein the first continuous web has a speed which corresponds to a minimum speed of the second continuous web.

11. The device of claim 1, wherein said sealing station is one of a heat sealing station, a stamping station, a gluing station, and a fastening station.

* * * * *